US007353642B1

(12) United States Patent
Henriquez

(10) Patent No.: US 7,353,642 B1
(45) Date of Patent: Apr. 8, 2008

(54) CONCRETE SLAB SYSTEM WITH SELF-SUPPORTED INSULATION

(76) Inventor: Jose Luis Henriquez, 4443 SW. 16th St., Miami, FL (US) 33134

( * ) Notice: Subject to any disclaimer, the term of this patent is extended or adjusted under 35 U.S.C. 154(b) by 0 days.

(21) Appl. No.: 08/502,907

(22) Filed: Jul. 17, 1995

(51) Int. Cl.
*E04B 5/16* (2006.01)
*E04B 1/16* (2006.01)

(52) U.S. Cl. ..... 52/741.41; 52/338; 52/414; 52/404.1; 52/408

(58) Field of Classification Search ..... 52/309.7, 52/309.12, 408, 443, 90.1, 22, 506.07, 506.06, 52/506.08, 404.1, 606, 607, 91.2, 335, 338, 52/414, 435, 741.41, 742.14; 249/18, 28–29; 156/71

See application file for complete search history.

(56) References Cited

U.S. PATENT DOCUMENTS 2,174,581 A * 10/1939 Hoge ..... 52/408 X
3,173,226 A * 3/1965 Solnick ..... 52/607 X
3,859,770 A * 1/1975 Chambers et al. ... 52/506.07 X
3,962,841 A * 6/1976 Carroll ..... 52/309
4,003,541 A * 1/1977 Lanier ..... 249/18
4,090,336 A * 5/1978 Carroll ..... 52/309.7
4,267,678 A * 5/1981 Carroll ..... 52/302
4,454,695 A * 6/1984 Person ..... 52/334
4,566,240 A * 1/1986 Schilger ..... 52/414
4,602,467 A * 7/1986 Schilger ..... 52/319
4,614,072 A * 9/1986 Price et al. ..... 52/506.08
4,625,484 A * 12/1986 Oboler ..... 52/251
4,642,951 A * 2/1987 Mortimer ..... 52/145
4,696,451 A * 9/1987 Mansfield ..... 249/16
4,759,160 A * 7/1988 Fischer ..... 52/91.2
5,207,035 A * 5/1993 Fowler ..... 52/506.06 X
5,279,090 A * 1/1994 Yamaguchi et al. ..... 52/506.08

* cited by examiner

*Primary Examiner*—Winnie Yip
(74) *Attorney, Agent, or Firm*—Melvin K. Silverman; Yi Li

(57) ABSTRACT

A concrete slab system with self supported insulation and method of making same which comprises a poured-in-place concrete slab with an insulation board held by metal or plastic C channels. The insulation is held in place on both sides by C channels. The C channels are in turn embedded into the concrete slab and as a result, the insulation is attached to the slab itself. The embedded C channels serve not only to support the insulation board but also as concrete form-work, therefore, allowing a variety of ceiling options on the under-side of the panels, while providing support for the reinforcing steel on the upper side of said panels. This system may be used for either an inclined or flat slab design, roofs or intermediate floor applications.

14 Claims, 20 Drawing Sheets

Fig. 1-A
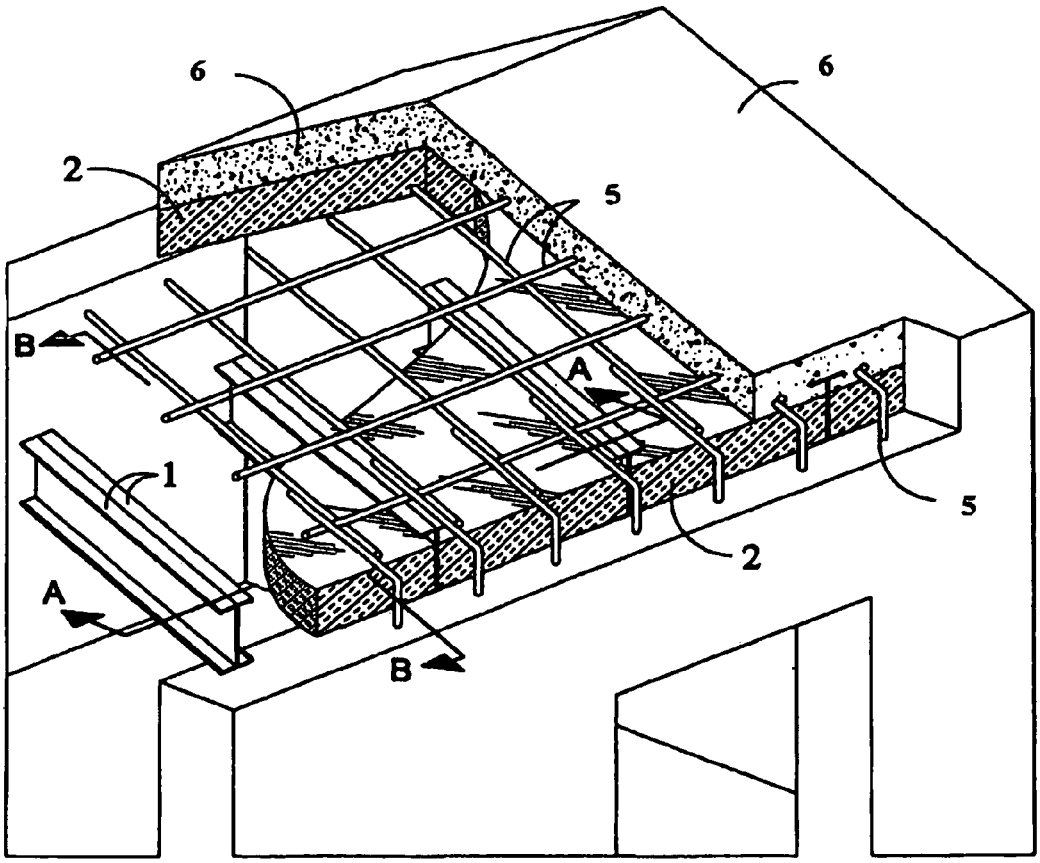

CONCRETE SLAB SYSTEM WITH SELF-SUPPORTED INSULATION

BACKGROUND OF THE INVENTION

1. Field of the Invention

The present invention relates to a construction method or system of making an insulated inclined or fat concrete slab system. This entails a process which methodically combines a poured-in-place concrete slab with insulation board in such a manner that said insulation remains self-supported by "C" channels of metal or plastic which are integrated onto the concrete slab itself. Besides providing insulating and sound proof properties, said board serves as a concrete forming system that eliminates the need for a wood or steel form.

2. Description of the Prior Art

The most commonly used residential and commercial floor and roof systems in the United States today rely primarily upon the use of wood trusses with plywood decking. This common practice is not only an environmental problem, but a fire hazard and possibly one of the least reliable construction methods for safety concerns in areas susceptible to hurricanes and tornados.

The use of concrete slabs is a most viable alternative, yet many concrete slabs systems leave a lot to be desired.

Concrete slabs are used in many countries, around the world due to the lack of wood or because it becomes an inexpensive way to build. In most of these countries the use of insulation is not required or mandated by city, state, or county codes. In the United States though, insulation is required in most areas. When used in conjunction with some types of pre-fabricated or poured concrete slabs, rigid or tapered insulation is primarily used on top of the concrete slab. Attempts have been made to integrate the insulation to the concrete slabs. The present invention addresses not only the integration between the insulation and the concrete by the use of the "C" channels, but the insulation becomes the form itself to which the concrete is poured over; thus, eliminating the use of plywood or steel forms to hold the concrete.

The prior methods have only been applied with the use of lightweight concrete or pre-cast panels. One such design can be found in U.S. Pat. No. 3,962,841 which discloses an insulated decking structure and method. This method uses custom made inverted metal "Y" shaped purlins and sub-purlins which serve as structural beams; also known as a composite system. However other designs variations to U.S. Pat. No. 3,962,841 include U.S. Pat. No. 4,267,678 and No. 4,090,336. Yet they do not offer a solution for attaching different styles and types of ceilings.

Moreover, all the existing systems do not offer a form-work advantage while providing insulating and sound proofing properties. This is the basis and main concept under the present invention.

In addition, many of the limited types of concrete slab systems marketed today tend to address commercial needs and are very expensive. Most offer a very limited aesthetic option and limit the consumer by not providing a viable economical alternative.

SUMMARY OF THE INVENTION

Accordingly, several advantages of the present invention are:

a. It provides a poured-in-place concrete slab system with self-supported insulation by means of embedded "C" channels made of metal or plastic, without the use of the traditional means of form-work. In other words, the insulation board substitutes any type of wood or metal form, while providing insulating and sound proofing properties to the slab structure.

b. It provides an environmentally safe slab alternative composed primarily of concrete in lieu of wood trusses and plywood decking.

c. It provides a fire resistant slab system due to the nature of the concrete itself. "C" channels composed of metal or plastic, which hold the insulation board, are embedded in the concrete and therefore acquire fire resistant qualities as well.

d. It provides a concrete slab system which, when used in conjunction with masonry walls or concrete walls, can serve as a protective shell, able to withstand hurricane and tornado wind gusts of great intensity.

e. It provides a poured-in-place concrete slab system wherein a variety of ceilings and roof coverings can be applied.

f. It provides a poured-in place concrete slab easy to build, with accessible materials; not custom made, and without the need for skilled labor.

g. It provides a form system which eliminates the need for the use of rebar chairs for the bottom reinforcing steel.

h. It provides a concrete stab system primarily for residential use but which is also applicable for commercial use as well, i. It provides an economical concrete slab alternative.

j. It provides an insulated stay-in-place forming system easy to build without the need of form-work dismantling.

BRIEF DESCRIPTION OF THE DRAWINGS

FIG. 1-A is a perspective view of the preferred embodiment of a section of the Concrete Slab System with Self-Supported Insulation.

DETAILED DESCRIPTION

Figure 1:
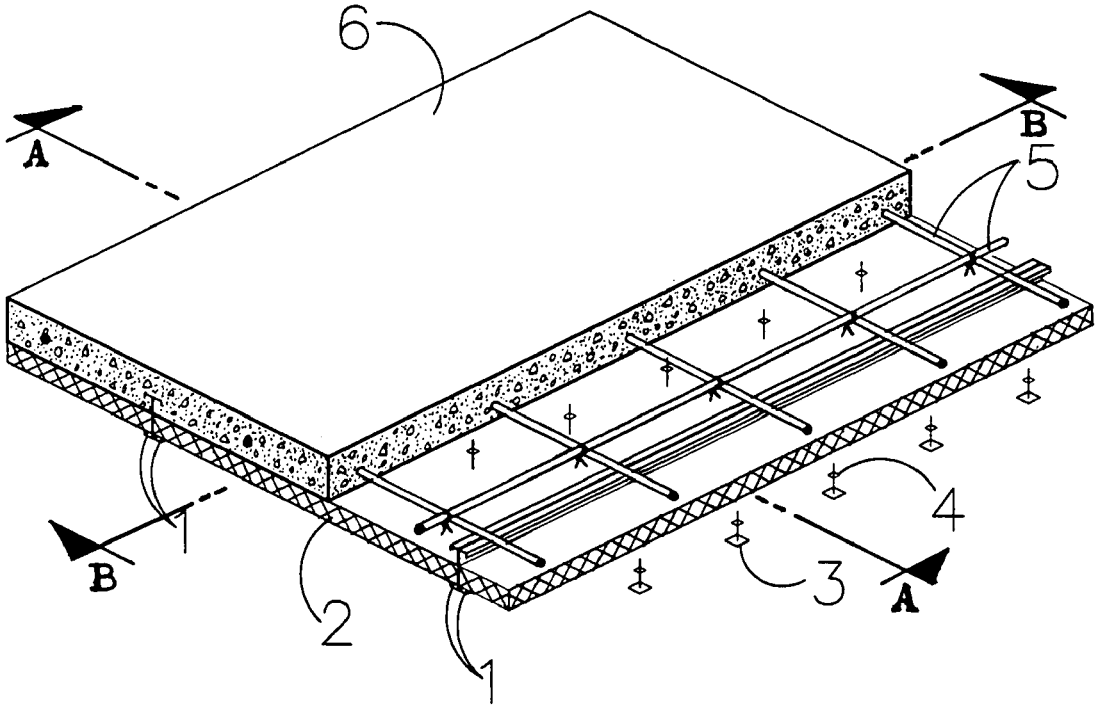
FIG. 1 is a perspective view of the preferred embodiment of an 8'×8' sectional of the Concrete Slab System with Self-Supported Insulation.
Figure 2:
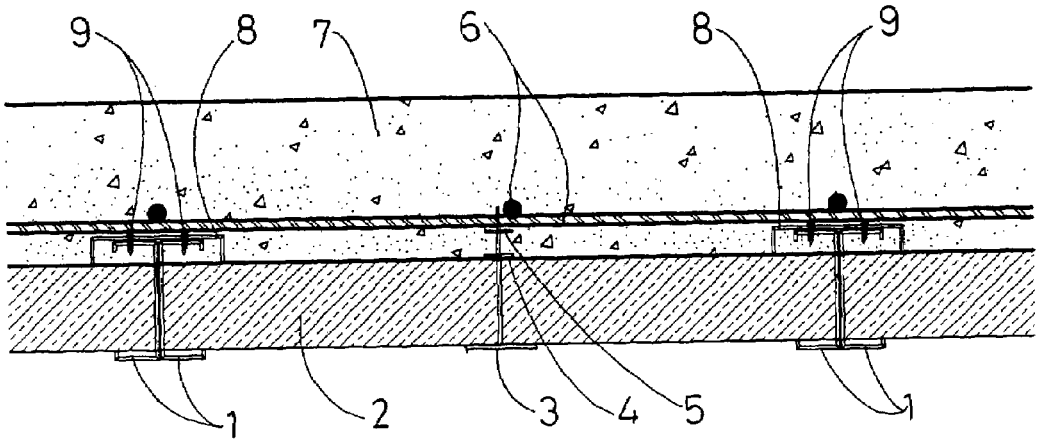
FIG. 2 is a cross sectional view taken in the direction of line AA of FIG. 1-A.
Figure 3:
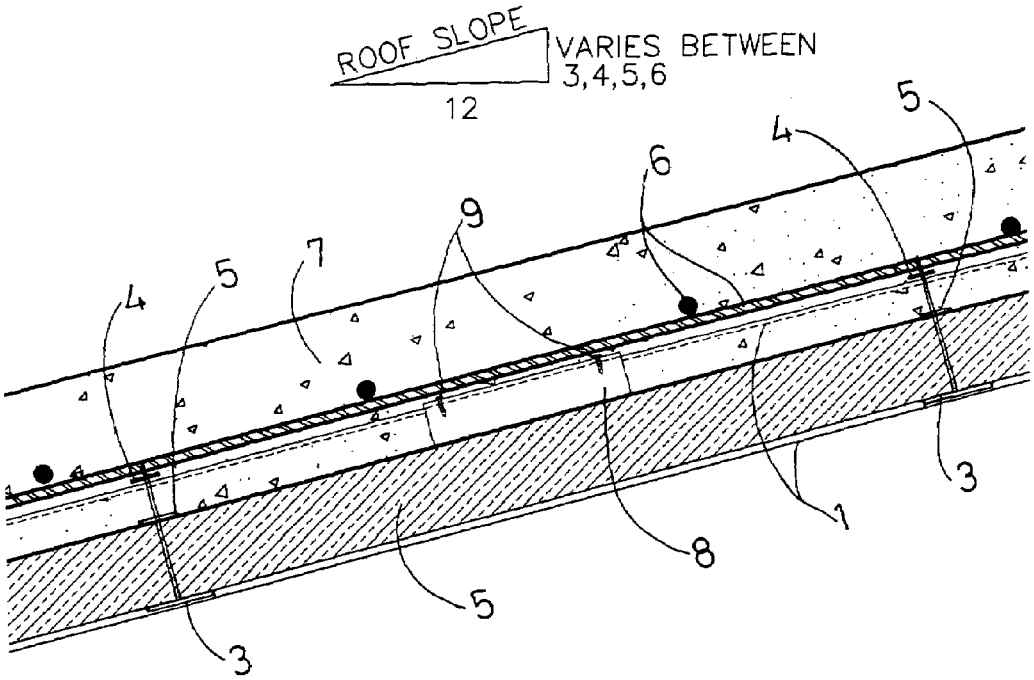
FIG. 3 is a longitudinal section view taken in the direction of line. BB of FIG. 1-A.

Referring to FIG. 1-A, the concrete slab system with self-supported insulation is composed of two "C" shaped metal or plastic studs herein called C channels 1, placed parallel with respect to each other. The longitudinal face of the insulation board 2 is placed against the web in the inner part of the "C" channels, while resting on the bottom flange of the C channel 1. Said insulation board 2 has the following characteristics: the type of insulation board 2 shall be any rigid insulation capable of resisting moisture, the load of the concrete 6, and live loads during the concrete 6 pouring process without losing its insulating properties. The thickness will vary according to applicable or required "R" values. The length, width, and thickness, varies according to the manufacturers.

The distance between the top surface of the insulation board 2 and the top flange of the metal or plastic "C" channel, shall always comply with the American Concrete Institute requirements regarding the minimum concrete 6 cover for steel slab reinforcement 5. Said steel reinforcement 5 will be resting on top of the top flange of the "C" channel. The size of the metal or plastic "C" channel will also vary according to the thickness of the insulation board 2. Galvanized metal stack-ups 3 having a depth greater than the thickness of the insulation board 2 may be manually inserted into the insulation board 2, and pressure washers may be pressed down unto the protruding part of the stack-ups.

Assembly Procedure

FIGS. 1, 1-A, 2 and 3 refers to the panel assembly of the preferred embodiment and the paneled formwork for inclined or flat slabs that will be described as follows:

1. Step one, place the bottom flange of the "C" channel 1 on top and perpendicular to the shoring beams or stringers, which are temporary support structures.
2. Step two, place the insulation board 2 inside the inner web of the "C" channel 1 while resting on the bottom flange of said C channel.
3. Step three, place the second "C" channel 1 on the opposite side of insulation board 2, in the same fashion as described on step two.
4. Continue and repeat steps 1 through 3 until the desired area is covered.
5. Then place reinforcing steel 5 over the top flange of the "C" channel 1.
6. Finally, pour concrete 6 over paneled form-work.

Note: No type of load shall be applied to the roof top until after the twenty-eighth day at which time the concrete 6 has gained the necessary strength to support the designed load.

Once the assembly procedure is complete, the following ceiling options may be used.

Figure 4:
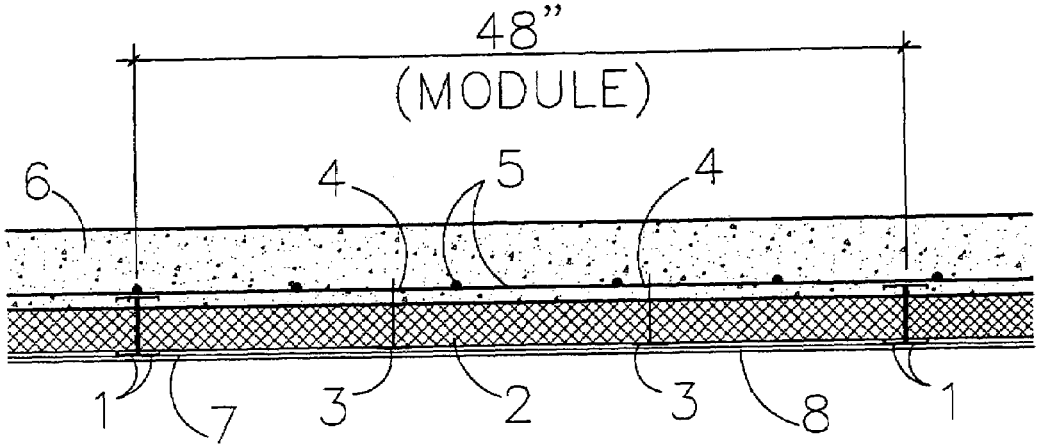
FIG. 4 is a cross sectional view taken in the direction of line AA of FIG. 1-A the view illustrates how a plaster ceiling is attached to the system.
Figure 5:
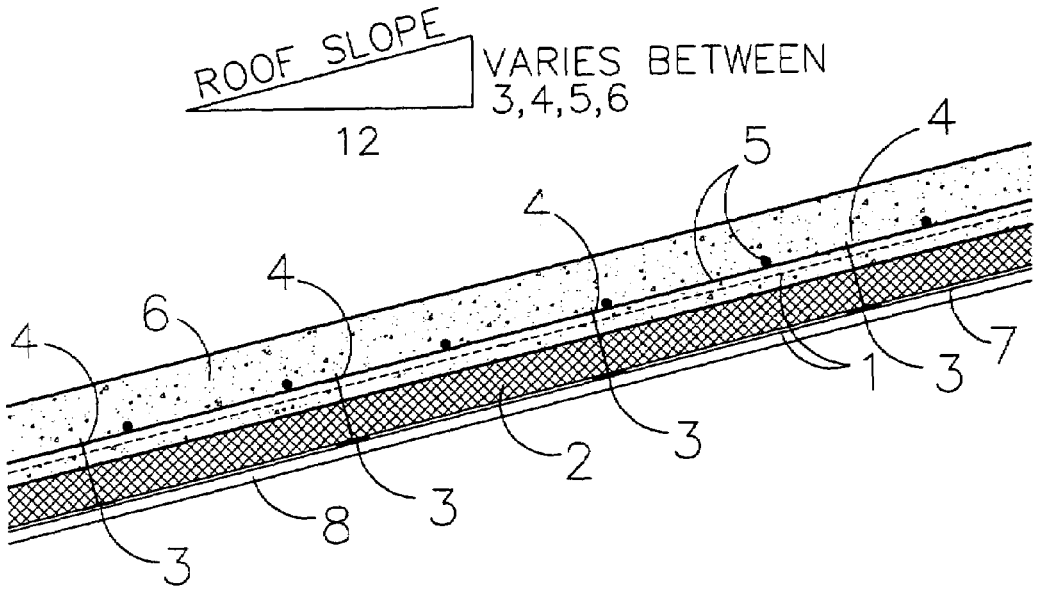
FIG. 5 is a longitudinal section view taken in the direction of line BB of FIG. 1-A the view illustrates how a plaster ceiling is attached to the system.

FIGS. 4 and 5 illustrate the roofing system with a plaster ceiling attached underneath. This option can be used when no electrical conduits or air conditioning ducts run through the area where the plaster ceiling will be applied. A metal lath or fiberglass mesh reinforcement 7 is to be attached to the metal C channels 1 and the insulation 2 according to manufacturer's specifications. Two coats of ⅝" plaster 8 are then applied according to desired textured finish.

Figure 6:
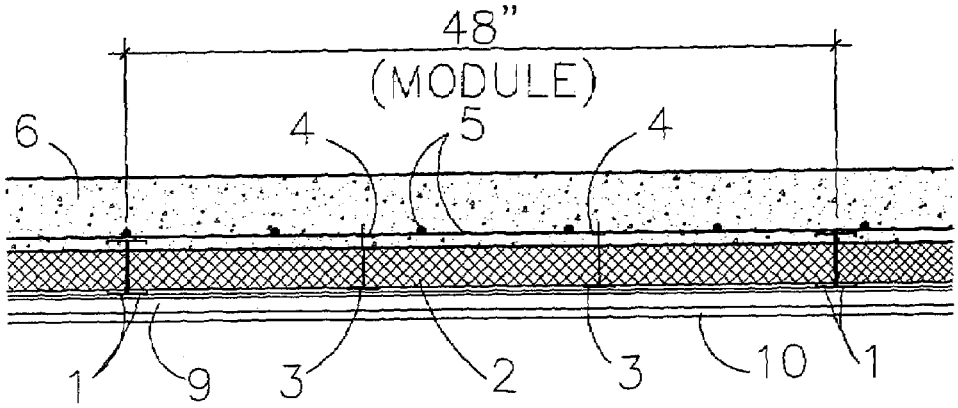
FIG. 6 is a cross sectional view taken in the direction of line AA of FIG. 1-A the view illustrates how a drywall ceiling is attached to the system.
Figure 7:
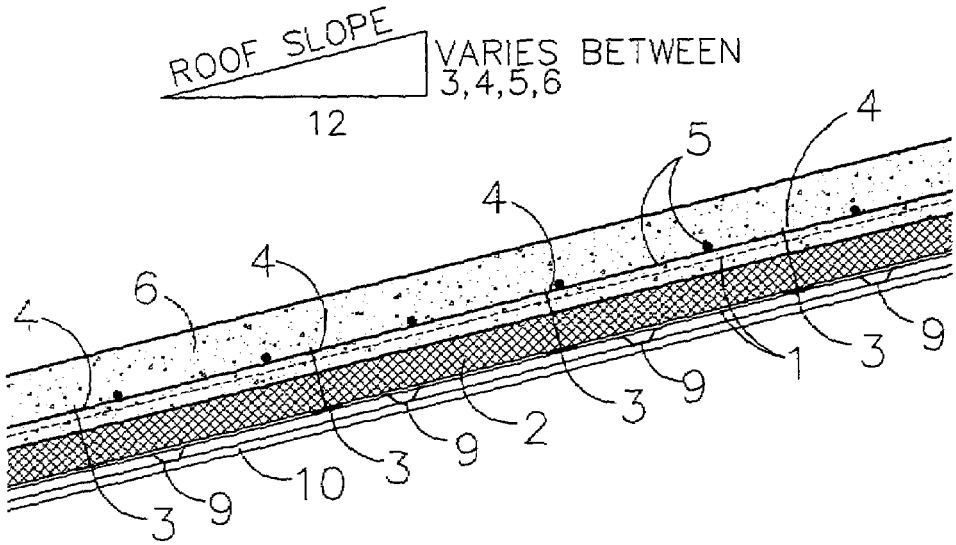
FIG. 7 is a longitudinal section view taken in the direction of line BB of FIG. 1-A the view illustrates how a drywall ceiling is attached to the system.

FIGS. 6 and 7 illustrate the roofing system with a drywall ceiling 10 attached underneath. Hi-hat metal furrings 9 are attached to the metal C channels 1. The furrings 9 are to be spaced at a distance of 16" on-center. One layer of ⅝" and/or ½" drywall 10 shall be applied below the furrings 9. This ceiling option may be used when certain types of electrical wiring and/or surface mounted lighting fixtures are used.

Figure 8:
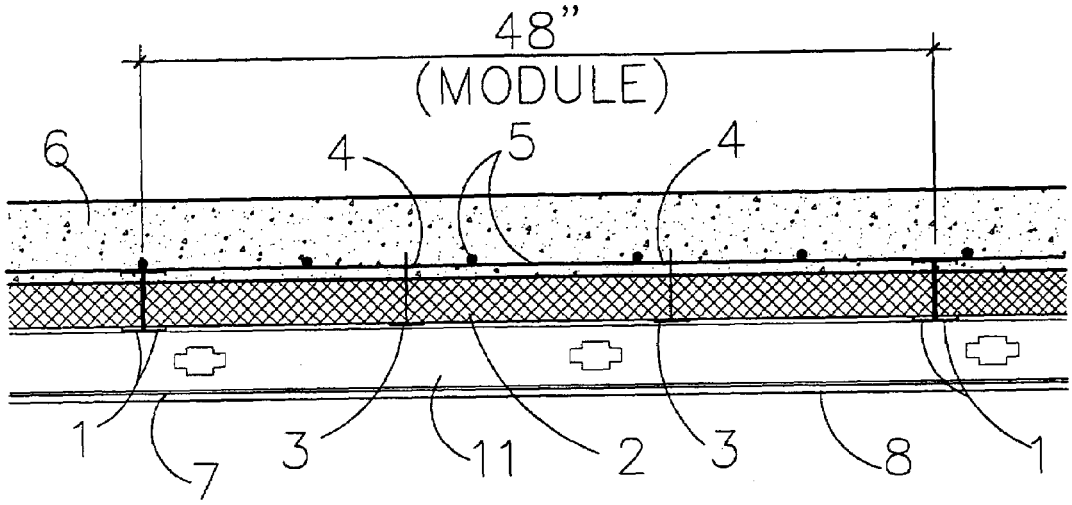
FIG. 8 is a cross sectional view taken in the direction of line AA of FIG. 1-A the view illustrates how a plaster ceiling held by metal studs or joists is attached to the system.
Figure 9:
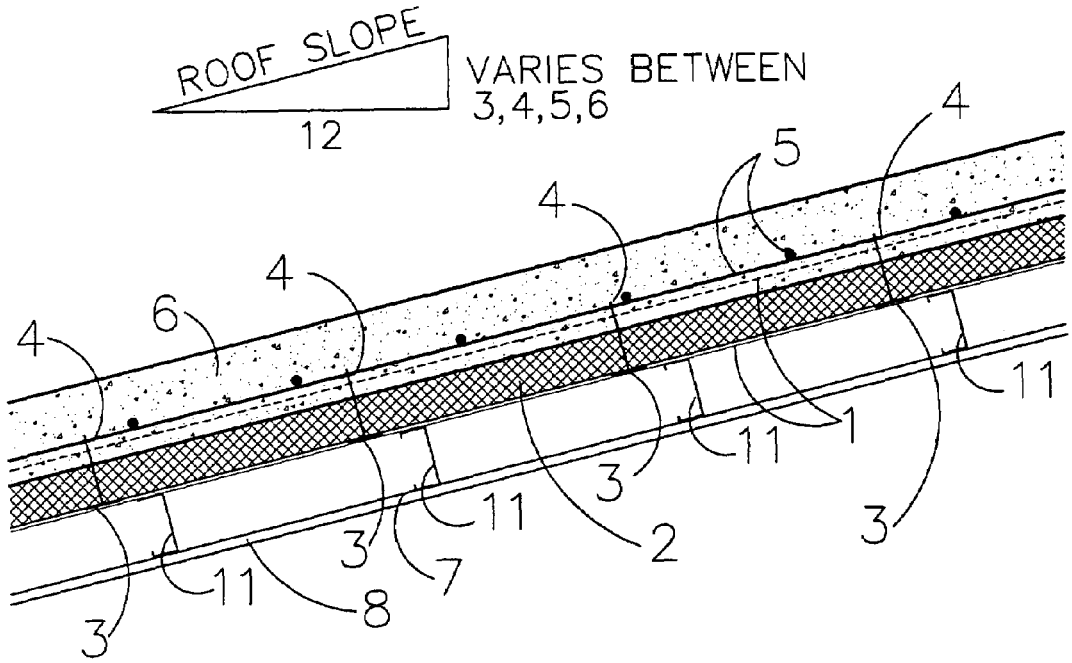
FIG. 9 is a longitudinal cross section view taken in the direction of line BB of FIG. 1-A the view illustrates how a plaster ceiling held by metal studs or joists is attached to the system.

FIGS. 8 and 9 illustrate the roofing system with metal studs 11 running perpendicular to the two side-by-side metal C channels 1. These will be spaced at a distance of 16" on-center. Attached to the metal studs 11 there shall be an expanded metal lath 7 with two coats of ⅝" plaster 8 applied according to desired textured finish. This option may be used when electrical conduits and/or recessed lighting is used in the area where the plaster ceiling will be applied.

Figure 10:
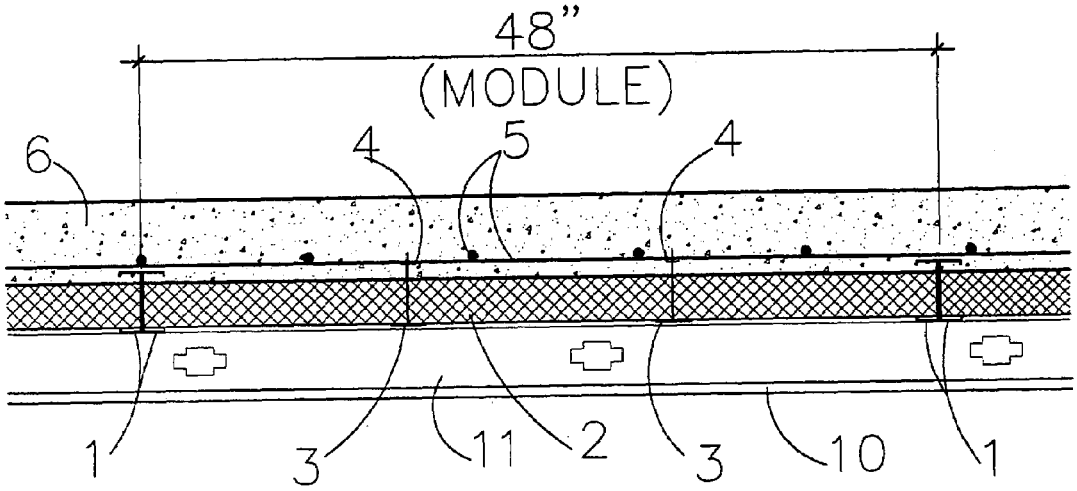
FIG. 10 is a cross sectional view taken in the direction of line AA of FIG. 1-A the view illustrates how a drywall ceiling held by metal studs or joists is attached to the system.
Figure 11:
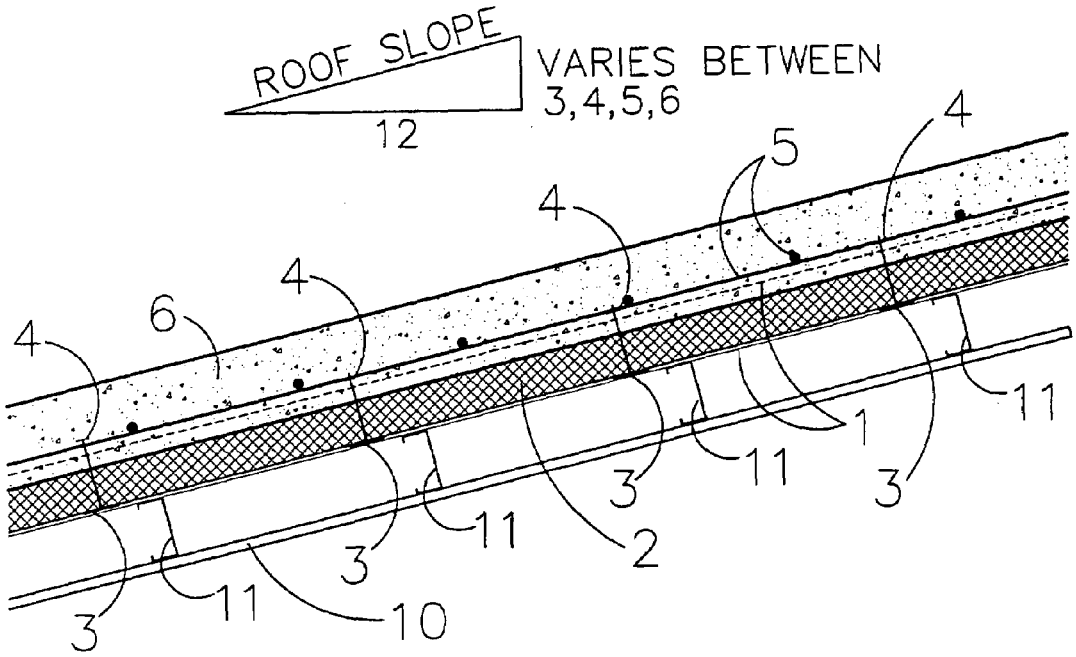
FIG. 11 is a longitudinal cross section view taken in the direction of line BB of FIG. 1-A the view illustrates how a drywall ceiling held by metal studs/joists is attached to the system.

FIGS. 10 and 11 illustrate the roofing system with metal studs 11 running perpendicular to the two side-by-side metal C channels 1. These will be spaced at a distance of 16" on-center. Below the metal studs 11, one layer of ⅝" or ½" drywall 10 shall be applied. This option may be used when electrical conduits and/or recessed lighting is used in the area where the plaster 8 ceiling will be applied.

Figure 12:
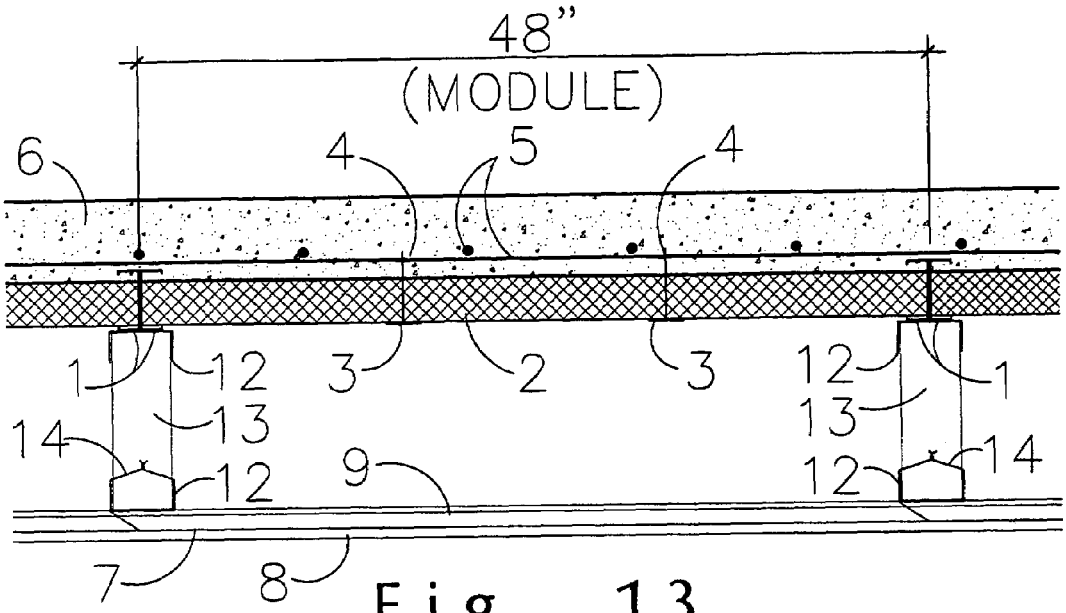
FIG. 12 is a cross sectional view taken in the direction of line AA of FIG. 1-A the view illustrates how a dropped plaster ceiling held by a metal stud frame is attached to the system.
Figure 13:
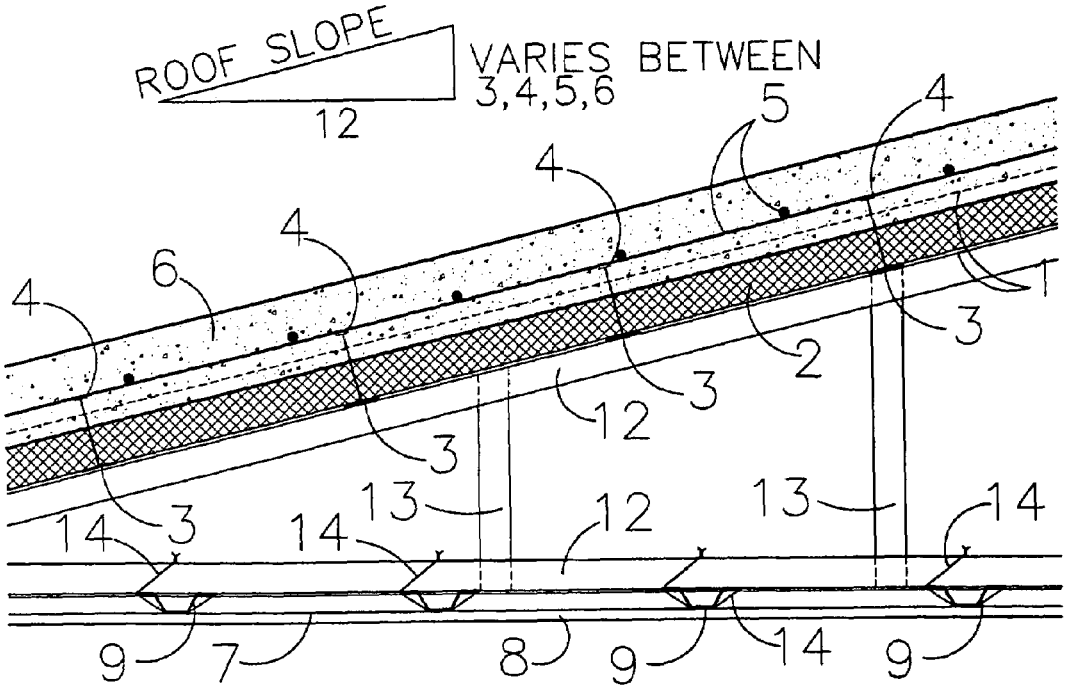
FIG. 13 is a longitudinal section view taken in the direction of line BB of FIG. 1-A the view illustrates how a dropped plaster ceiling held by a metal stud frame is attached to the system.

FIGS. 12 and 13 illustrate the roofing system with a dropped plaster 8 ceiling. Two sets of metal runner tracks 12 are to be attached to the C channels 1 and metal studs 13. The upper metal runner tracks 12 shall be attached to the C channels 1 in a in a lengthwise and parallel manner. The studs 13 shall be attached perpendicular to the tracks 12 at a distance of 16" minimum and 24" maximum. The lower metal runner tracks 12 shall be attached face-up to the bottom of the metal studs 13. Hi-hat furrings 9 shall be attached to the lower tracks 12 with galvanized steel wires 14. Said furrings 9 are to be placed transversely with relation to the tracks 12. An expanded metal lath 7 shall be attached to the hi-hat furrings 9. Two coats of ⅝" plaster 8 shall be applied according to desired texture. This option may be used when AC ducts need to be run throughout the ceiling.

Figure 14:
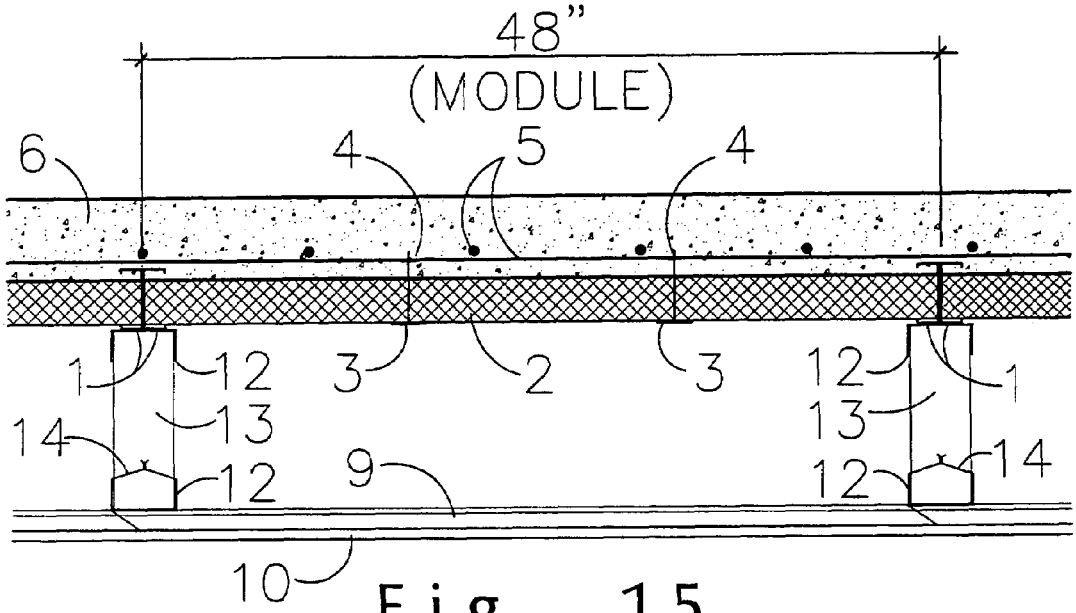
FIG. 14 is a cross sectional view taken in the direction of line AA of FIG. 1-A the view illustrates how a dropped drywall ceiling held by a metal stud frame is attached to the system.
Figure 15:
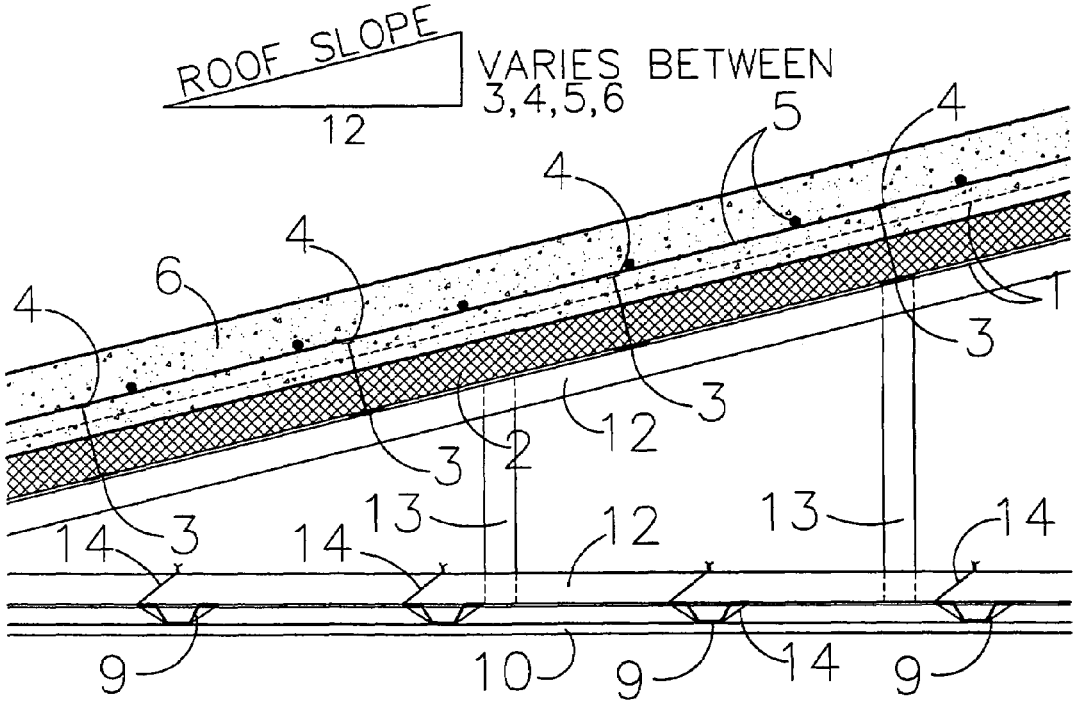
FIG. 15 is a longitudinal section view taken in the direction of line BB of FIG. 1-A the view illustrates how a dropped drywall ceiling held by a metal stud frame is attached to the system.

FIGS. 14 and 15 illustrate the roofing system with a dropped drywall 10 ceiling. Two sets of metal runner tracks 12 are to be attached to the metal C channels 1 and metal studs 13. The upper metal runner tracks 12 shall be attached to the metal C channels 1 in a lengthwise and parallel manner. The studs 13 shall be attached perpendicular to the metal runner tracks 12 at a distance of 16" minimum and 24" maximum. The lower metal runner tracks 12 shall be attached face-up toward the bottom of the metal studs 13. Hi-hat furrings 9 shall be attached to the lowertracks 12 with galvanized steel wires 14. Said furrings 9 are to be placed transversely with relation to the tracks 12. The dry wall ceiling 10 shall be attached to the hi-hat furrings 9. This option can also be used when AC ducts need to be run throughout the ceiling.

Figure 16:
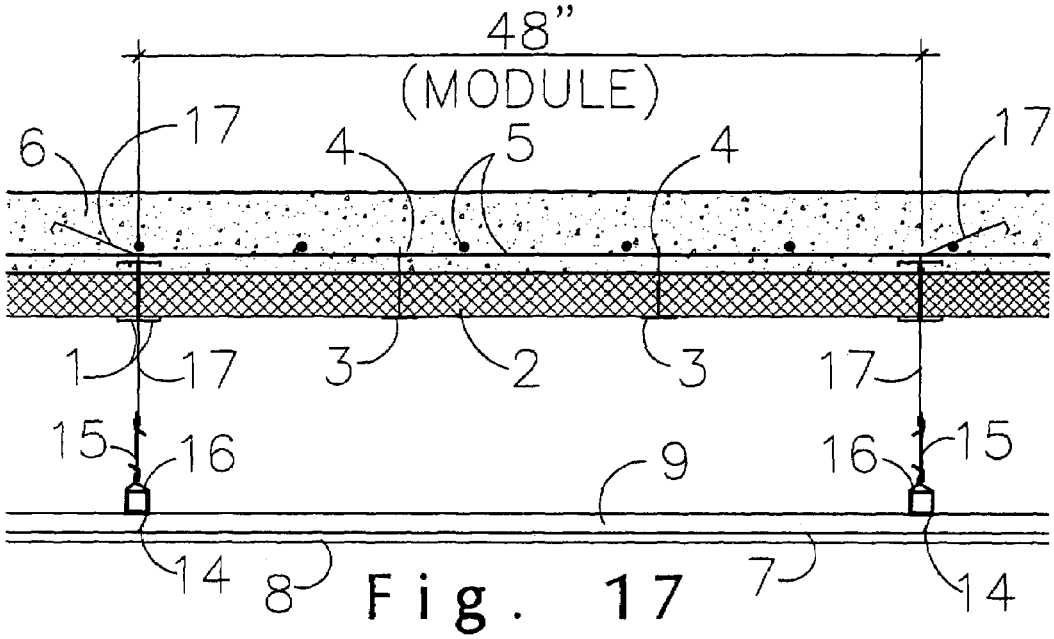
FIG. 16 is a cross sectional view taken in the direction of line AA of FIG. 1-A the view illustrates how a dropped plaster ceiling held by a steel hanger wire is attached to the system.
Figure 17:
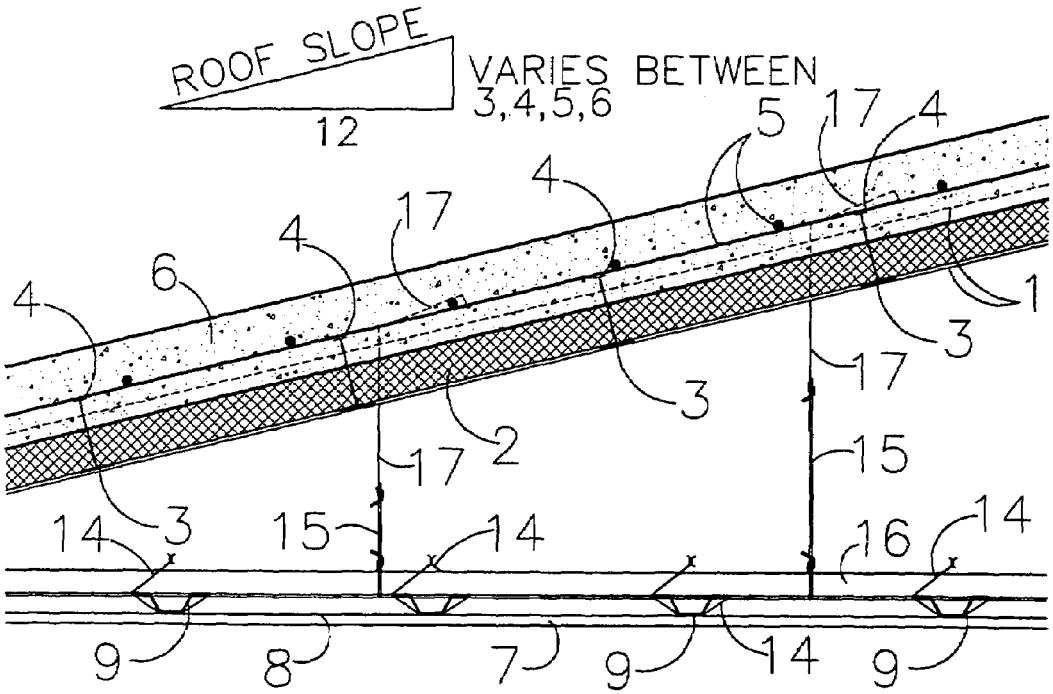
FIG. 17 is a longitudinal section view taken in the direction of line BB of FIG. 1-A the view illustrates how a dropped plaster ceiling held by a steel hanger wire is attached to the system.

FIGS. 16 and 17 illustrate the roofing system with a dropped plaster 8 ceiling hung by 20 gage galvanized steel wires 15. Galvanized metal straps 17 shall be placed between the metal C channels 1 at a distance of 48" each maximum. Said metal straps 17 will be bent on the lower ends between the form and the insulation 2. The upper ends will also be bent facing the insulation 2. Once the concrete 6 is poured, the metal straps 17 shall be embedded in the concrete 6. Once the form is removed, the lower ends of the metal straps 17 shall be aligned perpendicular to the insulation 2. A 20 gage hanger wire 15 shall be attached through the holes at the lower end of the metal straps 17. Underneath the wire 15 a 2" cold roller channel 16 shall be attached parallel to the metal studs. Hi-hat furrings 9 are to be placed perpendicular to the roller channel 16 at a distance of 16" minimum and 24" maximum on-center. The furrings 9 shall be attached to the roller channels 16 with wire 14 or clips. An expanded metal lath 7 shall be attached to the hi-hat furrings 9. Two coats of ⅝" plaster 8 shall be applied according to desired texture. This option may be used when AC ducts or pipes need to be run throughout the ceiling or when the design specifies a low flat ceiling.

Figure 18:
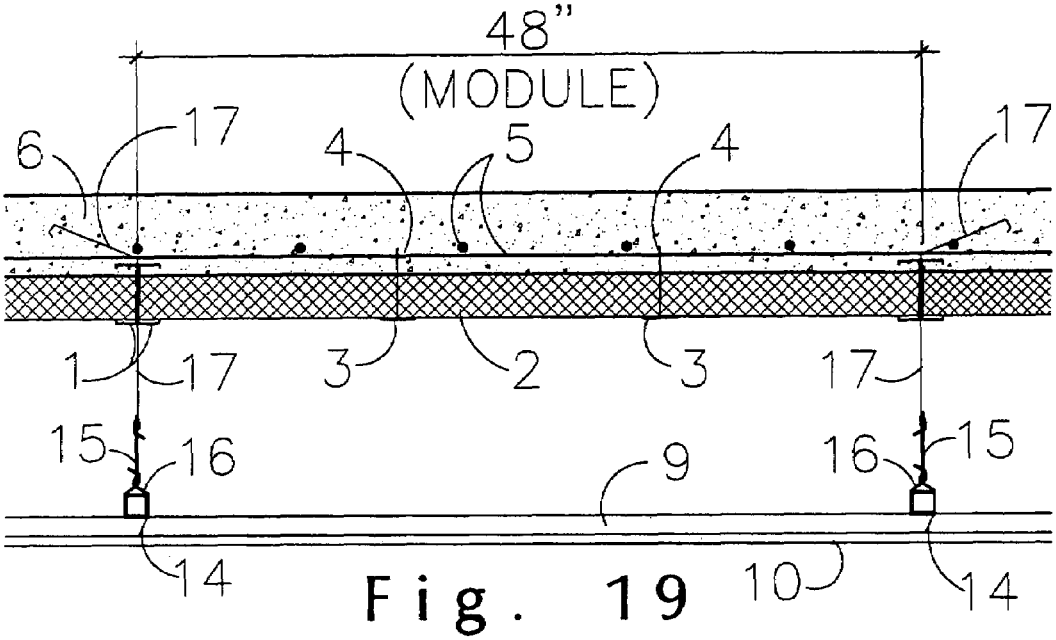
FIG. 18 is a cross sectional view taken in the direction of line AA of FIG. 1-A the view illustrates how a dropped drywall ceiling held by a steel hanger wire is attached to the system.
Figure 19:
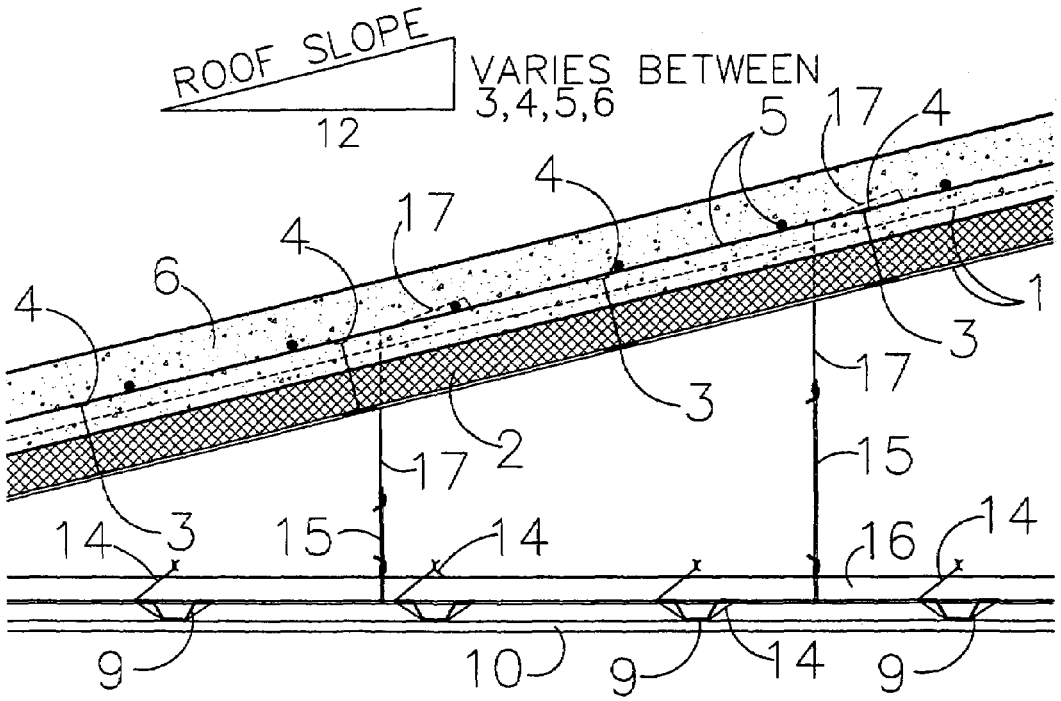
FIG. 19 is a longitudinal section view taken in the direction of line BB of FIG. 1-A the view illustrates how a dropped drywall ceiling held by a steel hanger wire is attached to the system.

FIGS. 18 and 19 illustrate the roofing system with a dropped drywall 10 ceiling hung by galvanized steel wires 15. Galvanized metal straps 17 shall be placed between the metal C channels at a distance of 48" each maximum. Said metal straps 17 will be bent on the lower ends between the form and the insulation 2. The upper ends will also be bent facing the insulation 2. Once the concrete 6 is poured, the metal straps 17 shall be embedded in the concrete 6. Once the form is removed, the lower ends of the metal straps 17 shall be aligned perpendicular to the insulation 2. A 20 gage hanger wire 15 shall be attached through the holes at the lower end of the metal straps 17. Underneath the wire 15 a 2" cold roller channel 16 shall be attached parallel to the metal C channels 1. Hi-hat furrings 9 are to be placed perpendicular to the roller channel 16 at a distance of 16" minimum and 24" maximum on-center. The furrings 9 shall be attached to the roller channels 16 with wire 14 or clips. The drywall 10 ceiling shall be attached to the hi-hat furrings 9. This option may be used when AC ducts need to be run throughout the ceiling and/or when the design specifies a low flat ceiling.

Figure 20:
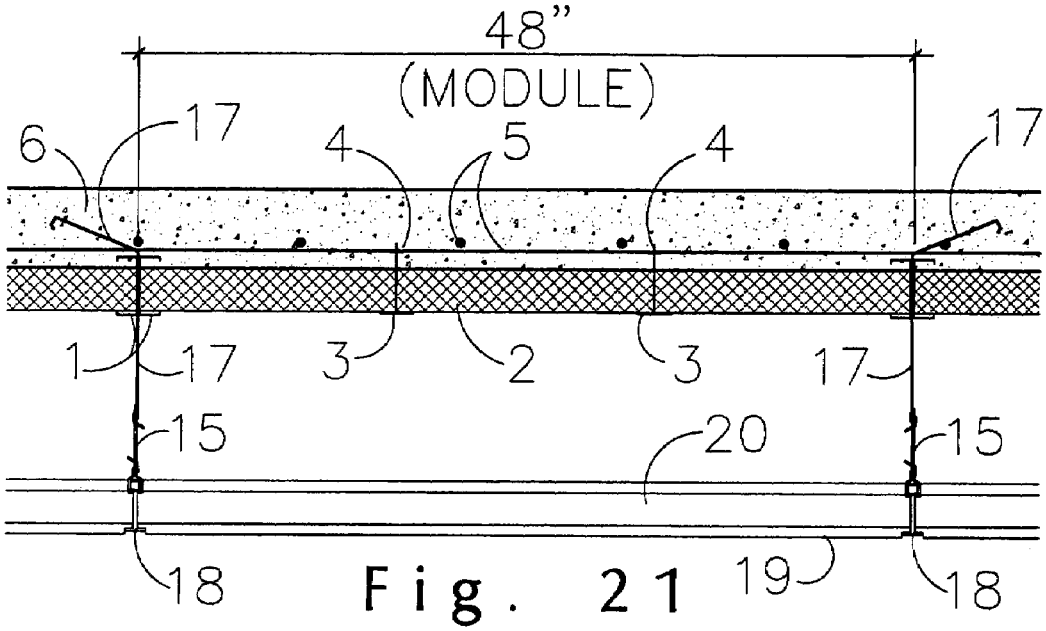
FIG. 20 is a cross sectional view taken in the direction of tine AA FIG. 1-A the view illustrates how a dropped acoustical ceiling held by a steel hanger wire is attached to the system.
Figure 21:
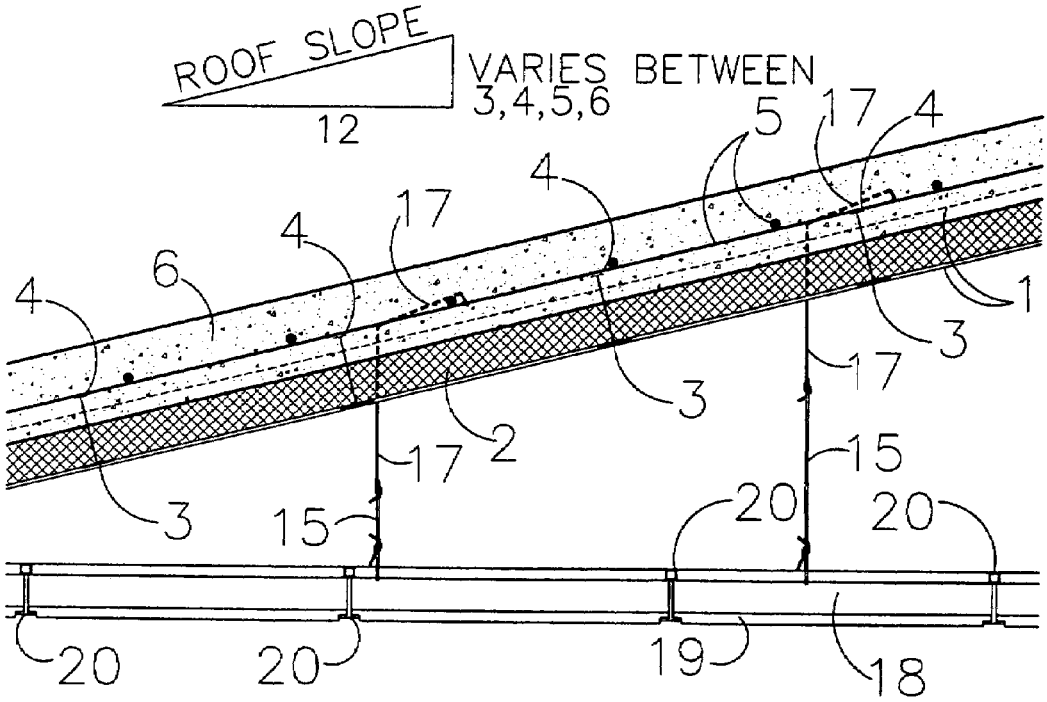
FIG. 21 is a longitudinal section view taken in the direction of line BB of FIG. 1-A the view illustrates how a dropped acoustical ceiling held by a steel hanger wire is attached to the system.

FIGS. 20 and 21 illustrate the roofing system with an acoustical tile ceiling hung by galvanized steel wires 15. Galvanized metal straps 17 shall be placed between the metal C channels 1 at a distance of 48" each maximum. Said metal straps 17 shall be bent at the lower ends between the form and the insulation 2. The upper ends will also be bent facing the insulation 2. Once the concrete 6 is poured, the metal straps 17 shall be embedded in the concrete 6. Once the form is removed, the lower ends of the metal straps 17 shall be aligned perpendicular to the insulation. A 20 gage hanger wire 15 shall be attached through the holes at the lower end of the metal straps 17. A main metal runner 18 shall be placed underneath the wires 15 parallel to the metal C channels 1. A T-Grid System 20 shall be placed perpendicular to the runner 18. Acoustical tiles 19 shall be placed on top of the T-Grid System 20. This option may be used for commercial purposes when running AC ducts, pipes, and wires through the ceiling.

The following roof covering options may be applied to said roofing system.

Figure 22:
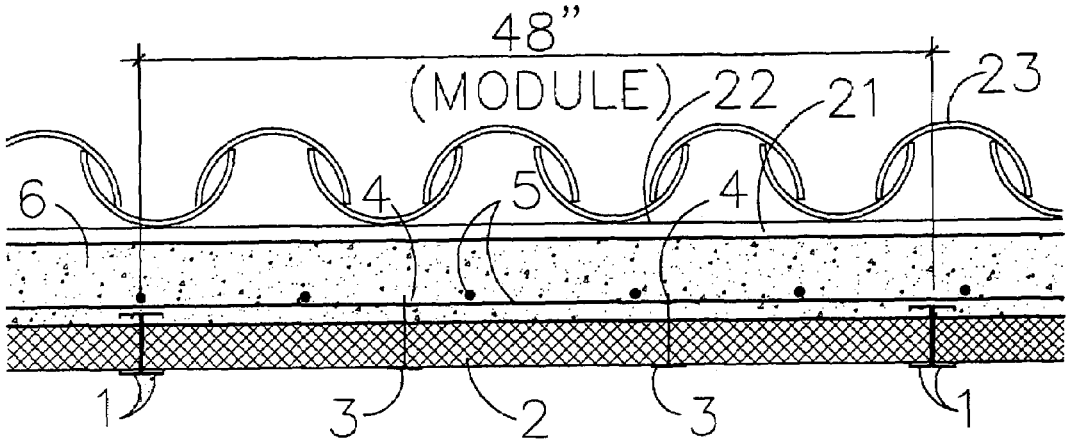
FIG. 22 is a cross sectional view taken in the direction of line AA of FIG. 1-A the view illustrates how a roof tile is applied to the system.
Figure 23:
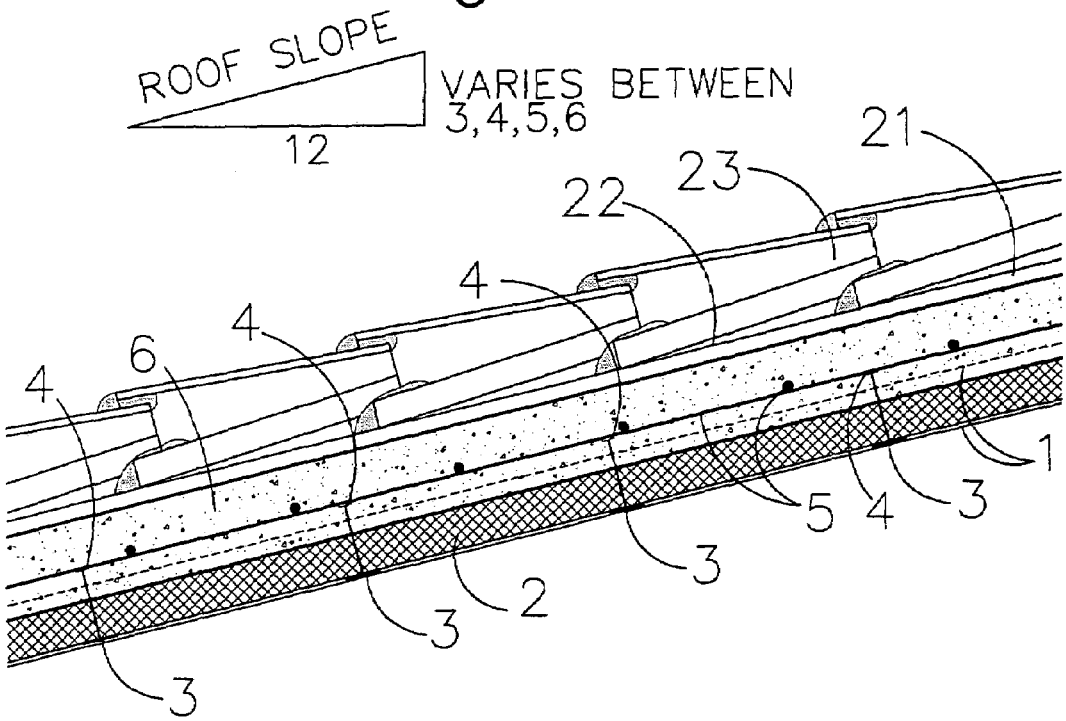
FIG. 23 is a longitudinal section view taken in the direction of line BB of FIG. 1-A the view illustrates how a roof tile is applied to the system.

FIGS. 22 and 23 illustrate the roofing system with cement or clay roof tile covering 23. After a one inch layer of mortar 21 has been applied to level the surface, then the sealer 22 is applied. The suggested water-proof sealer 22 for this system is THOROSEAL made by Thoro Systems Products. Two coats of said sealer 22 are to be applied in combination with ACRYL 60 (a product of Thoro Systems Products) after the first seven days when the concrete 6 is curing. After the twenty-eighth day, after the concrete 6 has completely cured, the tile 23 will be ready to be set on top of the prepared roof surface.

Figure 24:
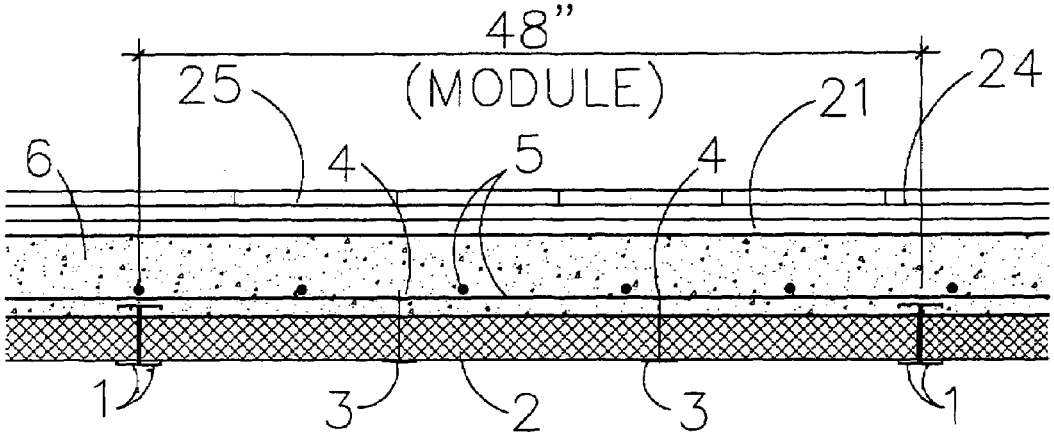
FIG. 24 is a cross sectional view taken in the direction of line AA of FIG. 1-A the view illustrates how shingle is applied to the system.
Figure 25:
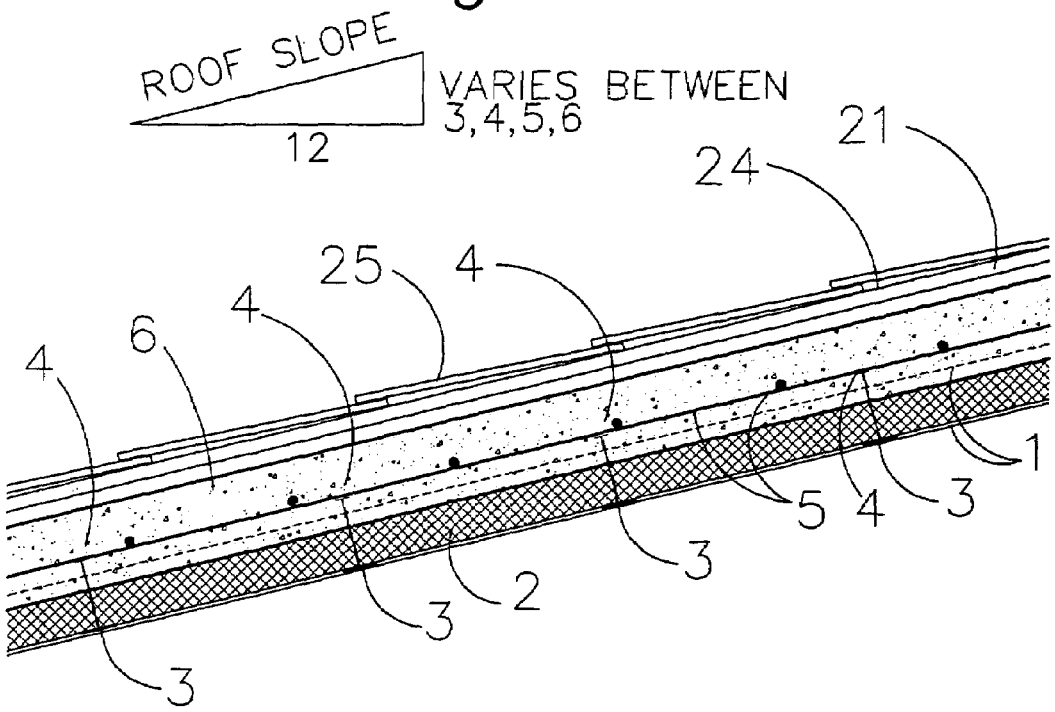
FIG. 25 is a longitudinal section view taken in the direction of line BB of FIG. 1-A the view illustrates how shingle is applied to the system.

FIGS. 24 and 25 illustrate the roofing system with a shingle 25 roof covering. After a one inch layer of mortar 21 has been applied to level the surface, then a 43# felt 24 shall be hot mopped on the leveled concrete 6 surface. Then the shingle 25 shall be glued on to the surface.

Figure 26:
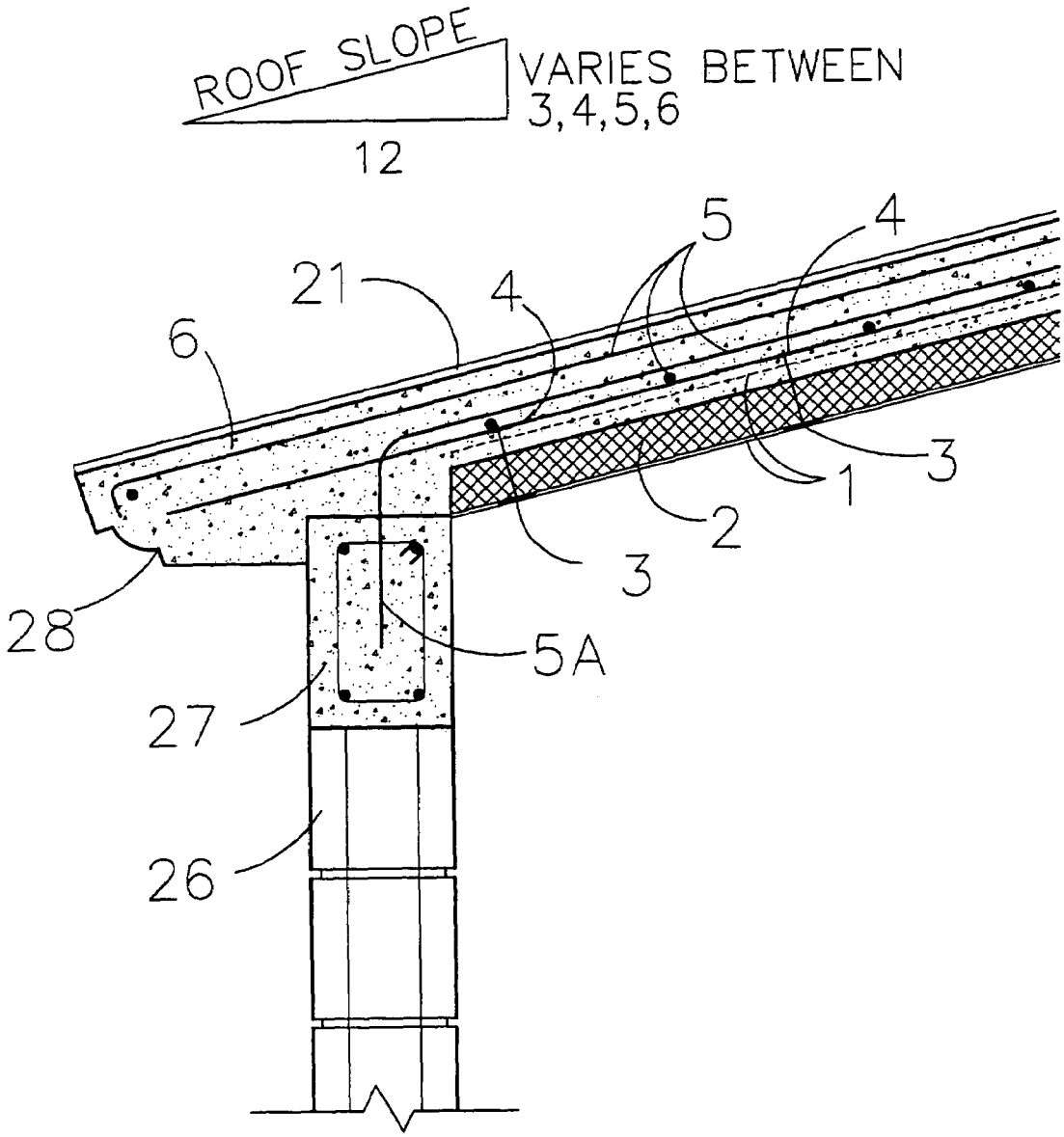
FIG. 26 is a cross sectional view of a concrete roof overhang with a poured-in-place decorative concrete fascia.

FIG. 26 illustrates the roofing system with a concrete overhang. This option may be used when the design specifies an overhang. Once the block walls and columns 26 are erected a roof beam 27 shall be placed on top. When the plywood or steel form is being placed, the concrete overhang shall be formed. The concrete fascia 28 shall then be formed or molded according to desired shape or design. A rebar 5A shall be placed along the roof beam 27 and hooked on to the concrete 6 slab for continuity of the structure. The size and distance shall be determined by engineering calculations (vary).

Ideally the beams 27, roof slab 6, and overhang shall be poured in place simultaneously. Otherwise, the beams 27 should be poured in place first leaving the specified rebars 5A partially exposed. Therefore, when the slab and the overhang are later formed, the rebars 5A are hooked to the roof slab and attached to the other rebars 5 forming a cold joint. In this manner continuity of the structure is maintained.

Figure 27:
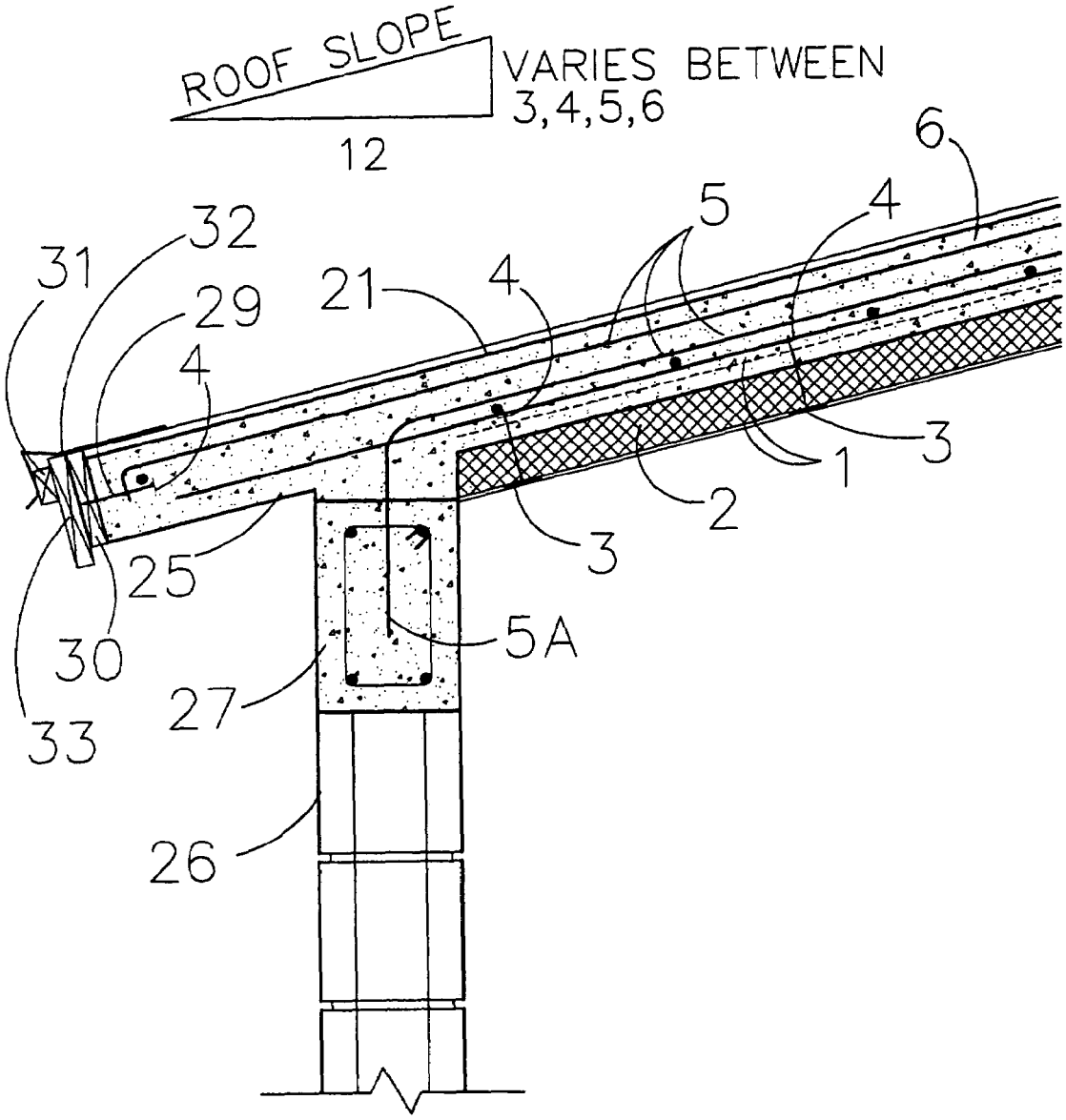
FIG. 27 is a cross sectional view of a concrete roof overhang with a pressure treated wood fascia applied to the system.

FIG. 27 illustrates the roofing system with a concrete overhang and a wood fascia. A simple concrete overhang is preferred because it does not involve the use of wood. Once the block walls and columns 26 are erected a roof beam 27 shall be placed on top. When the plywood or steel form is being placed, the concrete overhang shall be formed. Pressure treated wood 30 shall be placed at the end portion of the overhang form. Concrete nails 29 shall be inserted into the wood with pressure washers 4 at the tip in order to adhere properly to the concrete 6. The nails 29 may be inserted at a distance of 16 inches. Once the plywood or metal form is removed, the wood fascia shall remain embedded in the concrete 6. A nailer 31 shall be attached to the end of the wood fascia. A 3 inch continuous metal flashing 32 shall be attached to the nailer 31 on top of the mortar bed. The wood fascia 33 will vary according to architectural specifications.

Figure 28:
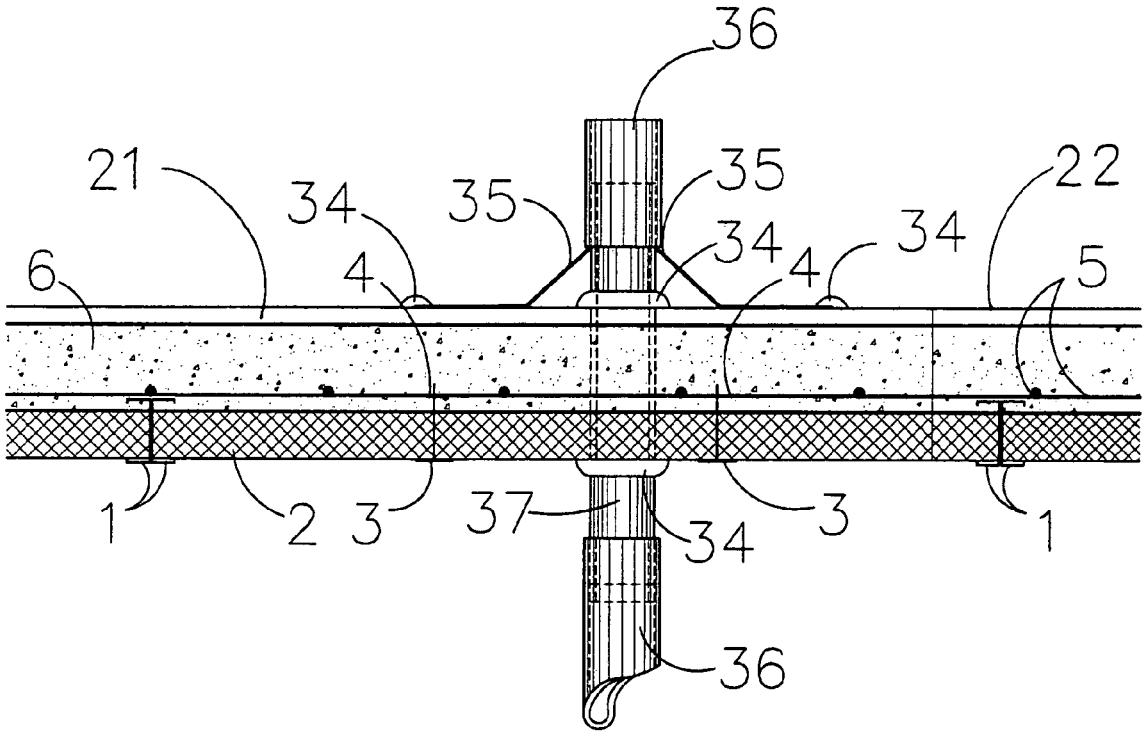
FIG. 28 is a cross sectional view of a sanitary-vent roof connection.

FIG. 28 illustrates the roofing system with a sanitary-vent roof connection. When the form is being placed a circular hole shall be made according to plumbing specs. A female pvc pipe 37 shall be tightly inserted into the hole at a minimum of 6 inches below the form and at a minimum of 6 inches above the mortar layer 21. Once the concrete 6 is poured and cured, and the first coat of sealer 22 has been applied, the area around the pvc pipe 37 shall be caulked. A lead sleeve 35 shall be attached to the top of the pvc pipe 37 in such a manner that the sleeve 35 extends downward to serve as a flashing. The downward extended portion of the sleeve 35 shall be caulked 34. A pvc male connection 36 shall be attached to the female pipe 37 and lead sleeve 35. A second coat of water proofing sealer 22 shall then be applied to the concrete roof surface.

Figure 29:
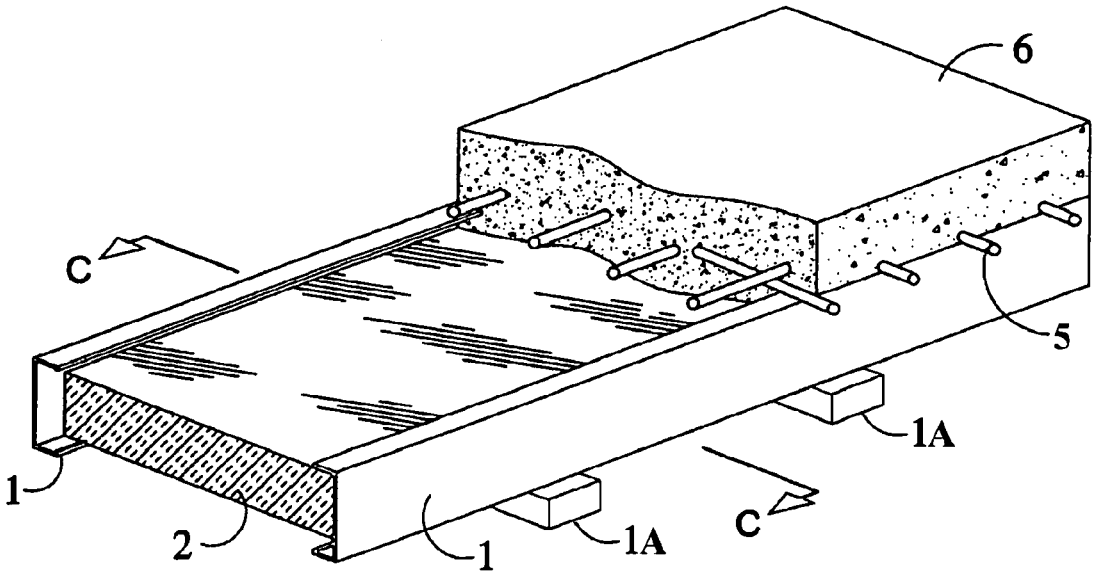
FIG. 29 is a sectional perspective view of a piece of FIG. 1-A.
Figure 30:
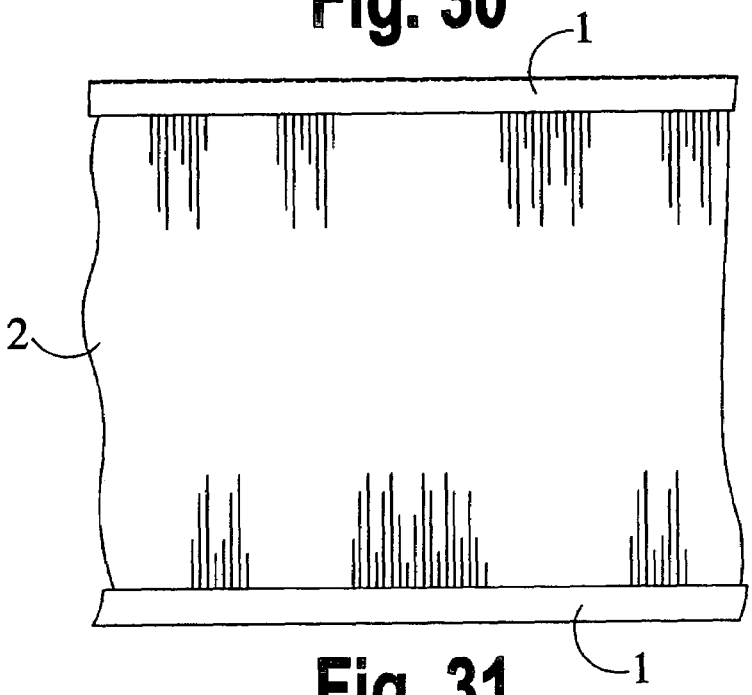
FIG. 30 is a plan view of FIG. 29.
Figure 31:
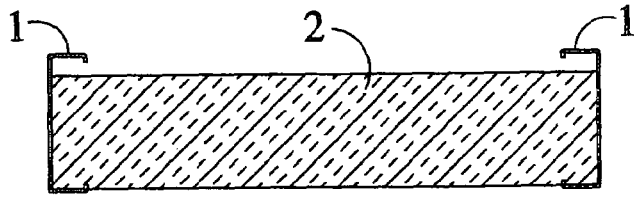
FIG. 31 is a cross-sectional view taken in the direction of line C-C of FIG. 29.
Figure 32:
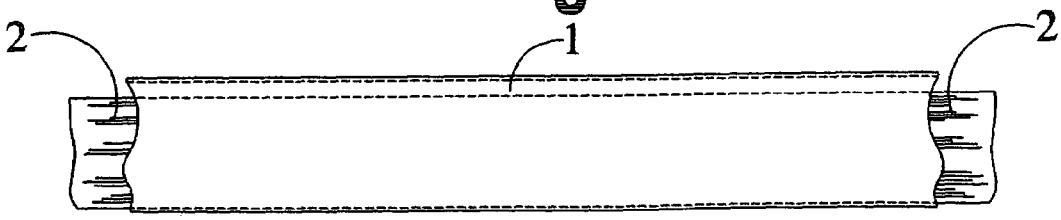
FIG. 32 is a side view of FIG. 29.

FIG. 29 is a sectional perspective view of a piece of FIG. 1-A. Shown is an insulation board 2 surrounded by two C channels 1. Lying on top of the uppermost C channel 1 flange is steel reinforcement 5. A layer of concrete 7 is poured on top of the insulation board 2 and embedded within the concrete 7 is the steel reinforcement 5. These elements are also shown in FIGS. 30-32. FIG. 30 is a plan view of FIG. 29. FIG. 30 shows the insulation board 2 and two C channels 1. FIG. 31 is a cross-sectional view taken in the direction of line C-C of FIG. 29. FIG. 31 shows the gap between the insulation board 2 and the top flange of the C channel 1, which is filled with concrete 6 when the concrete 6 is poured onto the form. FIG. 32 is a side view of FIG. 29. FIG. 32 shows the insulation bard 2 within the C channels 1.

Figure 33:
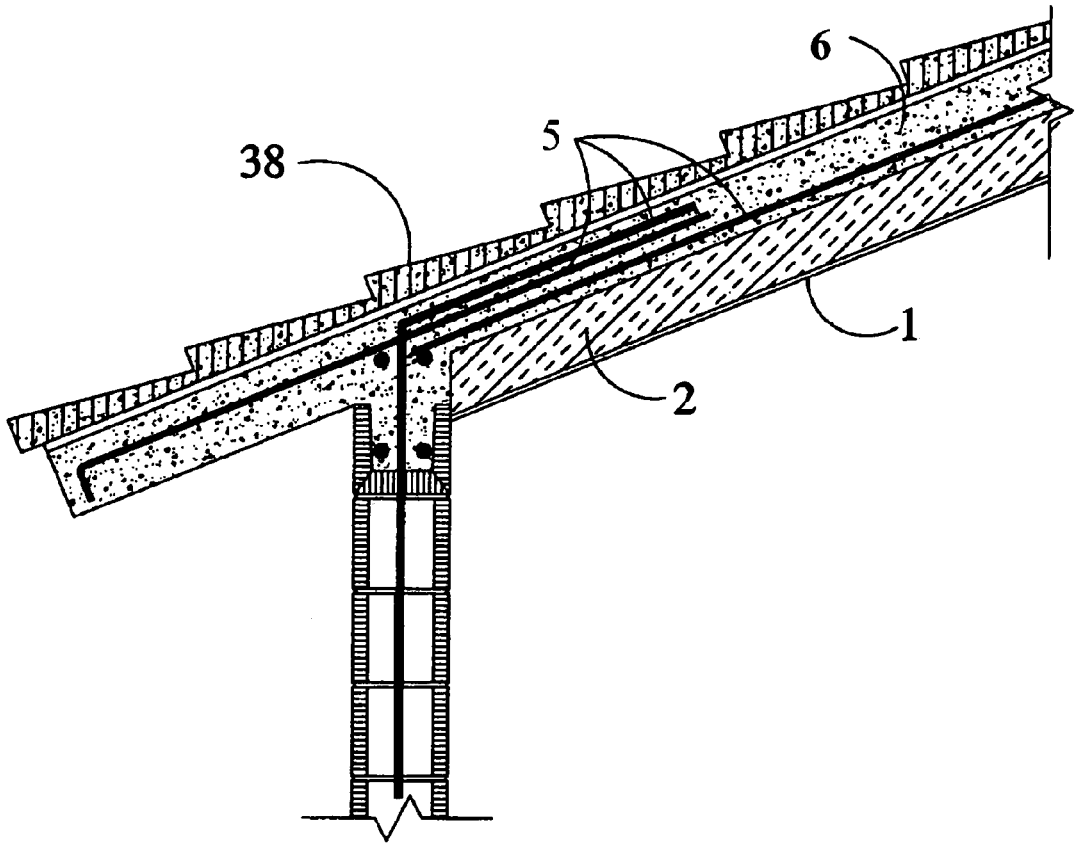
FIG. 33 is a cross-sectional view taken in the direction of line B-B of FIG. 1-A with an applied stamped finish on the roof system.

FIG. 33 illustrates the roof system with an alternate stamping option. The stamping is applied immediately after the concrete 6 has been poured to avoid separate curing processes. Such stamping is done through the use of a form liner that simulates various existing roof finishes such as roof tile, shingles, Bermuda, metal, or wood shakes 38. Coloring for the desired applications is specified within the mix used. A clear sealer could be applied over the cured stamped finish for further weatherproofing.

The concrete slab system with self-supported insulation 2 is an alternative which provides an innovative way of assembling the form-work with insulation board 2 and at the same time, offers a variety of ceiling options and roof coverings, without sacrificing the aesthetic aspect of the architectural design nor the structural design. Thus, speeding up the erection of the shoring equipment and reducing the construction calendar. This is accomplished through the innovation of combining the use of metal or plastic C channels and insulation boards 2 which are in turn embedded into the concrete 6 itself.

One of the most important functions of this system is to provide a safe and secure structural system which primarily meets the needs of residential homes. It is a slab alternative which can be utilized in hurricane and tornado susceptible areas. This system, when used in a structural roof (inclined or flat slab), provides a safe and secure structural shell.

I claim:

1. A method for making a self-supporting insulated concrete roof or intermediate floor comprising the steps of:

installing at least one stay-in-place insulated form, wherein said form includes insulation secured between at least two C channels;

supporting said at least one stay-in-place insulated form from underneath with temporary support structures;

placing reinforcing steel over said stay-in-place insulated form;

pouring a concrete slab over said insulated form and said reinforcing steel, wherein said concrete is poured to a certain depth and said concrete directly contacts and adheres to at least one fourth of said at least two C channels; and removing said temporary support structures after said concrete dries, whereupon said insulated concrete roof is self supporting.

2. The method of claim 1, further comprising the step of securing a drywall ceiling to said embedded at least two C channels.

3. The method of claim 1 further comprising the step of securing a plaster ceiling to said embedded at least two C channels.

4. The method of claim 1 further comprising the step of securing a dropped plaster ceiling to said embedded at least two C channels.

5. The method of claim 1 further comprising the step of attaching at least one embedded metal strap to said embedded at least two C channels.

6. The method of claim 5 further comprising the step of attaching at least one steel hanger wire to said at least one embedded metal strap.

7. The method of claim 6 further comprising the step of attaching a dropped plaster ceiling to said at least one steel hanger wire.

8. The method of claim 6 further comprising the step of attaching a dropped drywall ceiling to said at least one steel hanger wire.

9. The method of claim 6 further comprising the step of attaching a dropped acoustical ceiling to said at least one steel hanger wire.

10. The method of claim 1 further comprising the step of installing a tile roof covering to said insulated concrete roof.

11. The method of claim 1 further comprising the step of installing a shingle roof covering to said insulated concrete roof.

12. The method of claim 1 further comprising the step of installing a sanitary-vent roof connection on said insulated concrete roof.

13. The method of claim 1 further comprising the step of applying a stamp finish to said insulated concrete roof.

14. The method of claim 1 further comprising the step of attaching a metal sheet covering to said insulated concrete roof.

* * * * *